United States Patent [19]

Bernahl et al.

[11] Patent Number: 4,744,568

[45] Date of Patent: May 17, 1988

[54] TARGET SYSTEM FOR LOW VELOCITY PROJECTILES

[76] Inventors: Jeffery H Bernahl, Mt. Prospect, Ill.; Drake D. Mertes, executor, First National Bank Bldg., 701 Lee St., Suite 790, Des Plaines, Ill. 60016

[21] Appl. No.: 851,927

[22] Filed: Apr. 14, 1986

[51] Int. Cl.[4] ..... F41J 1/14

[52] U.S. Cl. ..... 273/404

[58] Field of Search ..... 273/404, 410

[56] References Cited

U.S. PATENT DOCUMENTS

| | | | |
|---|---|---|---|
| 1,804,117 | 5/1931 | Russell | 273/410 X |
| 1,886,562 | 11/1932 | Le Fever | 273/404 X |
| 1,935,174 | 11/1933 | Bisaillon et al. | 273/410 |
| 1,981,293 | 11/1934 | Varrelman | 273/404 |
| 2,332,148 | 10/1943 | Horr | 273/348 X |
| 2,397,921 | 4/1946 | Cole | 273/410 |
| 3,088,738 | 5/1963 | Meyer | 273/404 |
| 3,122,367 | 2/1964 | Dale | 273/404 X |
| 3,319,960 | 5/1967 | Wilcox | 273/404 |
| 3,495,829 | 2/1970 | Booth | 273/404 |
| 3,944,227 | 3/1975 | Nilsson | 273/410 |
| 4,247,116 | 1/1981 | McQuary | 273/404 X |
| 4,470,604 | 11/1984 | Hoffmann | 273/404 |

OTHER PUBLICATIONS

Popular Mechanics. 11-1978, p. 208.

*Primary Examiner*—Paul E. Shapiro

[57] ABSTRACT

A target system which has a box like structure and includes a kinetic energy absorption sheet suspended from the top of the box diagonally downwardly to a point adjacent to the junction of the back wall of the box and the bottom. The major plane of the kinetic energy absorption sheet and the back wall of the box define an angle of 20±7 degrees.

4 Claims, 2 Drawing Sheets

TARGET SYSTEM FOR LOW VELOCITY PROJECTILES

FIELD OF THE INVENTION

The present invention concerns a target system for trapping low velocity projectiles and more particularly to a target system in which the energy of the projectile is generally absorbed thus eliminating rebound.

BACKGROUND OF THE INVENTION

In any type of home target system one of the most important elements is the means whereby the projectile is trapped. This means must be capable of absorbing sufficient of the projectiles' kinetic energy such that rebound and/or ricocheting does not occur. This is most important when projectiles such as steel BB's are used, since they do not lose kinetic energy through distortion upon impact.

An additional matter which increases the complexity of the energy absorption involves the angle at which the projectile strikes the kinetic energy absorption means in the target system. As is apparent, the height and position of the shooter with respect to the target system allows for a multiplicity of different possible paths which the projectile may take on its way to contact with the kinetic energy absorption means.

In short, once a projectile has entered the trap system regardless of the angle, means must be provided to absorb its kinetic energy whereby entrapment is insured.

However, factors which must be considered with entrapment are: weight; mobility; cost; replacement of parts; prolonged life; ease of detecting hits; reuse of the projectiles; and noise.

BRIEF DESCRIPTION OF THE PRESENT INVENTION

In accordance with the present invention, there is provided a trap system for projectiles such as BB's having velocities up to 350 feet per second (fps) which includes all of the desirable features above enumerated and functions virtually noise free.

The trap system means includes a generally box like means having a top member and solid bottom and back and side member means. The entire front is open and a partition means, also provided with an open area, is suspended from the top member means to the bottom member means. In one embodiment a lip is provided off the front portion of the top member means from which a target can be suspended. In another embodiment the target can be suspended across the open area in the partition means.

The construction material of these portions of the trap system must be strong enough to sustain prolonged use yet allow penetration of a BB upon impact. Cardboard such as 200 lb. test "B" flute corrugated has been found to be preferred, although "B" flute corrugated cardboard of from 175 lbs. to 225 lbs. test has been found to be suitable.

The kinetic energy absorption means is a flap or sheet like structure suspended at its upper end from the top member at a point, behind the partition means and in front of the back member means. It extends diagonally and downwardly to a point on the back member means generally adjacent to its juncture with the bottom means. The kinetic energy absorption means in the sheet form extends across the entire area and while not freely suspended, is not taut rather however, exhibiting a degree of looseness or fullness over its surface. In a preferred embodiment, it is attached to the back member means by the use of an adhesive means. However it is understood that any means which will support the kinetic energy absorption means with the required degree of fullness will be satisfactory.

In line with the above, a primary object of the present invention is to provide a trap system for BB's up to 350 fps which has a kinetic energy absorption means that absorbs the kinetic energy of the BB such that rebound and/or ricocheting outside of the trap system does not occur.

Another object of the invention is to provide a BB trap system which has an open front to improve the visual determination of target hits.

Still another object of the invention is to provide a box like BB trap system having a kinetic energy absorption means which will absorb the kinetic energy of a BB striking it at generally any angle to its major plane as long as the BB passes through the major plane of the open front.

But another object of this invention is to provide a box like BB trap system having a kinetic energy absorption means which extends diagonally across said box like BB trap system and exhibits a degree of fullness, is low in cost and weight, allows for the reuse of the projectiles and is mobile.

BRIEF DESCRIPTION OF THE DRAWINGS

Having in mind the above objects and other attendent advantages that would be evident from an understanding of this disclosure, the invention comprises the devices, combinations, and arrangement of parts as illustrated in the presently preferred form of the invention which is hereinafter set forth in detail to enable those skilled in the art to readily understand the function, operation, construction and advantages of same when read on conjunction with the accompanying drawings in which.

DETAILED DESCRIPTION OF THE PRESENT INVENTION

Figure 1:
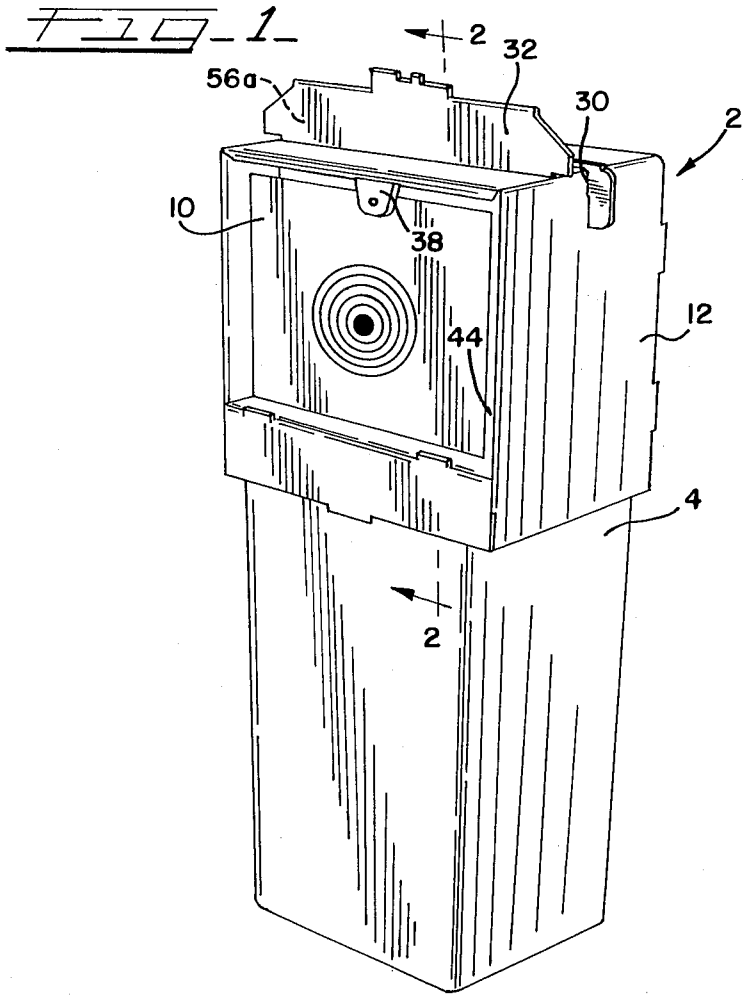
FIG. 1 is a perspective view of an exemplary target system for trapping low velocity projectiles mounted upon a stand.
Figure 3:
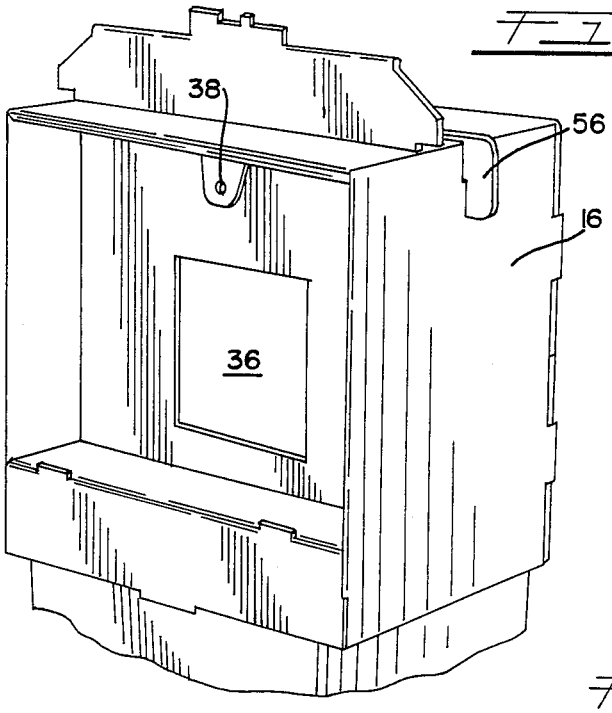
FIG. 3 is a partial perspective view of the target system without the target.
Figure 4:
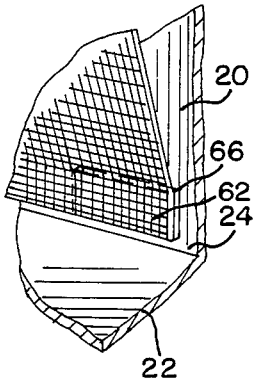
FIG. 4 is a fragmentary enlarged perspective view of the adhesive means employed to secure the kinetic energy absorption means to the back member.

First referring to FIG. 1 wherein is shown a target system means 2 for trapping low velocity projectiles such as BB's. In this particular embodiment a stand means 4 is provided which can be of any particular design but constructed of cardboard as of the type and kind previously described and discussed. It is to be understood that the target system hereunder consideration is designed ideally for trapping projectiles having velocities up to 350 fps.

Figure 2:
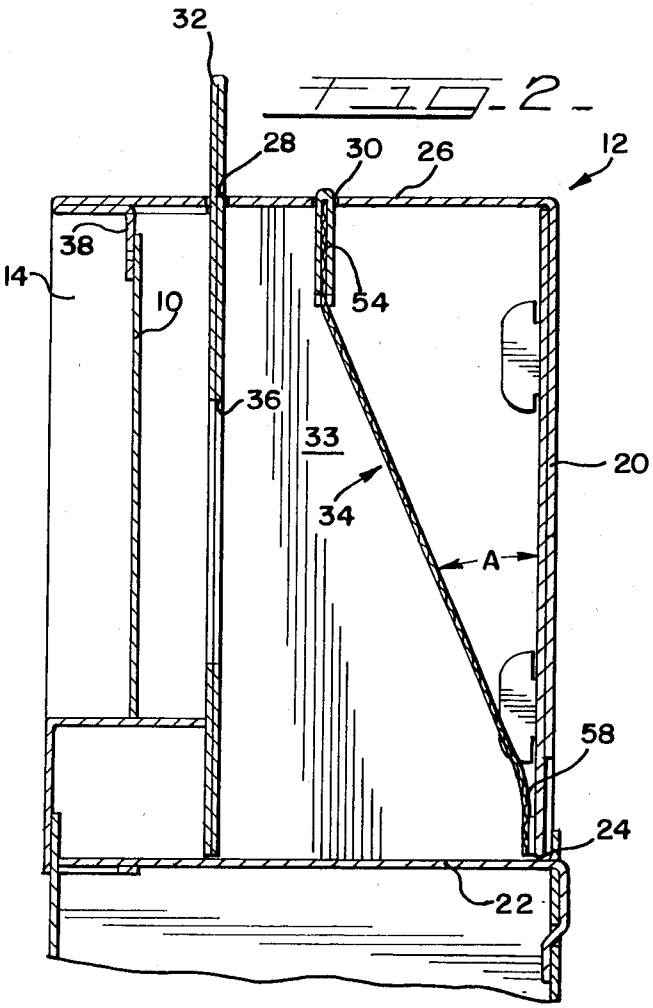
FIG. 2 is a partial sectional view of the target system taken on Line 2—2 of FIG. 1.

Now referring to FIGS. 1 and 2 it will be noted that the target system means 2 has a box like housing means 12 which in one embodiment is constructed of cardboard of the type previously discussed. The box like housing means 12 includes: an open front means 14, solid first and second side means 16 and 18, a solid back means 20 and a solid bottom means 22 which share a common juncture means 24. Also included is a top means 26 that has first and second horizontally extending opening means 28 and 30. The first of which opening means 28 is designed to receive a partition means 32, the second of which opening 30 is designed to receive and support kinetic energy absorption means 34. The partition means 32 is provided with a hole or open region means 36 which aids in the detection of hits by allowing light from the interior 33 to pass through the holes created by the projectile. The target means 10 may be supported directly on partition means 32 or in the embodiment shown from a tab means 38, which is part of the top lip means 40 that is formed when the housing 12 is assembled. Corresponding first and second side lip means 42 and 44 and bottom lip means 46 are also formed during assembly as shown by the arrows in FIG. 5. As is apparent the various lip means are folded, of at least one layer of suitable cardboard as mentioned and held in place by friction. The target means 10 can be secured to the tab means 38 by adhesive means or in any other suitable manner.

Figure 5:
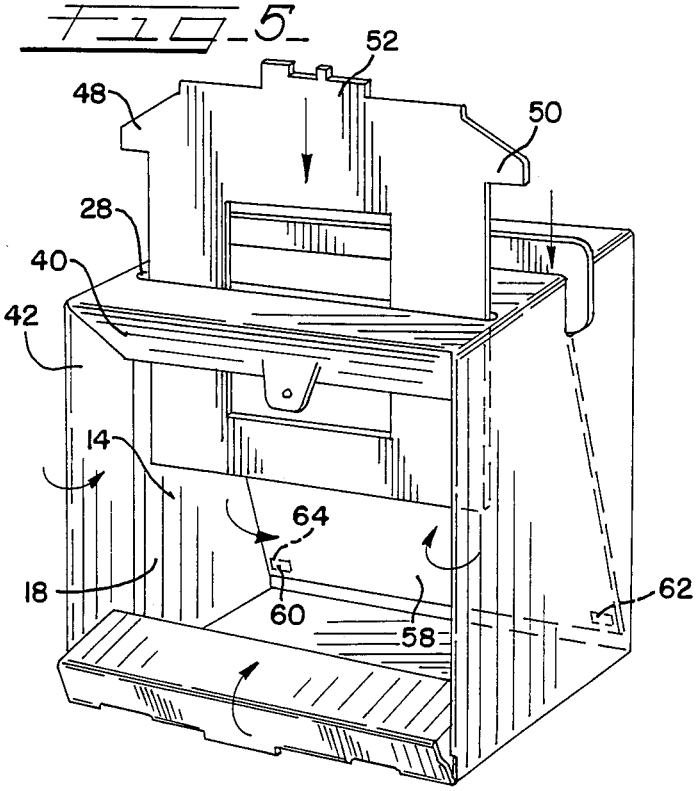
FIG. 5 is a perspective view without a target showing the partition means partially raised and having a portion of the internal structure shown in dotted lines in order to reveal internal normally concealed parts.

The partition means 32 includes first and second ear means 48 and 50 and a crown means 52. As is apparent the ear means support the partition means while the crown means 52 provides a handle for easy removal and replacement as shown in FIG. 5.

As shown in FIG. 2, the kinetic energy absorption means 34 in the preferred embodiment is sheet like in nature and generally extends diagonally and downwardly from a base portion means 54 positioned in said horizontally extending opening 30 to a point on the back means adjacent to the juncture means 24. The base portion means 54 is provided with identical hanger means 56 and **56*a* (not shown) for cooperation with the second horizontally extending opening means 30 to support and yet allow removal of the kinetic energy absorption means 34. A tip portion means 58 of the kinetic energy absorption means 34 includes first and second edge means 60 and 62 which in a preferred embodiment are provided with a pressure sensitive adhesive pad means 64 and 66**.

In practice the sheet like kinetic energy absorption means 34 is inserted into the horizontally extending opening 30 once the box like structure means 12 is assembled. It is pulled in until the hanger means 56 and **56*a* are secure against the first and second side means 16 and 18. The absorption means 34 is then grasped by the adhesive pad means for example and extended downwardly through the space 33 between the front 14 and back means 20. Sufficient force is exerted thereon such that the tip 58 is generally adjacent to the juncture means 24, at which point the pressure sensitive pad means 64 and 66 are secured against the back means 20**.

It has been found that the kinetic energy absorption means should have a degree of fullness or looseness to provide maximum use and efficiency. It should be understood that it is not taut nor does it hang freely. By employing such a manual stretching procedure and the relationship of the particular dimensions of the box like housing and kinetic energy absorption means such a fullness can be achieved. A simple determination of these dimensions will allow the scaling up or down of the target system.

Referring to FIG. 2, it is understood that generally the back means 20 and the kinetic energy absorption means 34 each sweep out major planes and that an angle "A" exists therebetween. In an embodiment the kinetic energy absorption means is constructed of "Cordura" which is the registered trademark of Du Pont for its family of air textured, high-tenacity nylon fibers. In a preferred embodiment a sheet of "Cordura" brand having the following physical properties is employed: Denier perfilament - 7.1; weight in oz. per sq. yard - 11.31; thickness in inches - 0.022; bulk in cc. per gram - 1.50; grab strength in lbs. wapr - 613; mullen burst strength in lbs. per sq. in. - 799 and modified Wyzenbeek abrasion (cycles to failure) warp - 4491.

We have found that with this particular material when orientated generally at the angle of 20±7 degress will absorb the kinetic energy of a projectile at generally most of the angles at which it could hit the kinetic energy absorption means as long as the projectile passes through the major plane of the open front means 14. A narrower and more preferred angle would be an angle of 20±2 degrees. I have determined that in extreme cases when the BB passes through the major plane of the open front means it will either pass through two layers of cardboard i.e. a lip means and side means, or the partition means and the bottom means, etc. In other cases, the BB will hit the kinetic energy absorption means directly, or hit a layer of cardboard first then the kinetic energy absorption means.

Thus there has been provided, in accordance with the invention, a Target System for Low Trapping Velocity Projectiles that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

Having thus adequately described our invention, what we claim is:

1. A target system for trapping low velocity projectiles of up to 350 feet per second comprising:

means for forming a box-like housing including means providing an open front on said housing, first and second means providing the sides of said housing, means providing a back of said housing, means for providing a top for said housing, means located behind said means providing said open front providing a partition within said housing and extending across the open front, said partition providing means including means forming a target; and means for absorbing kinetic energy extending diagonally and downwardly generally from said means for providing a top to said means providing a back of said housing whereby the major plane of said means for absorbing kinetic energy and the major plane of said means providing a back form an angle of generally 20, plus or minus 7 degrees.

2. The target system of claim 1 wherein said means for absorbing kinetic energy has a base portion and said means for providing a top has a horizontally extending opening therein whereby said base portion is generally carried in said horizontally extending opening.

3. A target system for trapping low velocity projectiles of up to 350 feet per second comprising:

a box-like housing including: an open front, solid first and second sides, a solid back and a solid bottom which share a common juncture, a top having at least one horizontally extending opening therein, a partition having a hole therein located behind said open front and extending thereacross; and a sheet-like means for absorbing kinetic energy having a base portion and tip portion including first and second edges, said base portion being movably carried in said horizontally extending opening means and said tip portion being secured to said back adjacent to said common joint whereby said means for absorbing kinetic energy extends diagonally and downwardly from said horizontally extending opening to said back and has a degree of fullness.

4. The target system of claim 3 wherein said means for absorbing kinetic energy has a major plane and said back has a major plane whereby forming an angle of about 20, plus or minus 2 degrees, therebetween.

* * * * *